US006935246B2

(12) United States Patent
Eder et al.

(10) Patent No.: US 6,935,246 B2
(45) Date of Patent: Aug. 30, 2005

(54) PRE-TABLE FOR CONTAINER TREATMENT MACHINES

(75) Inventors: Erich Eder, Donaustauf (DE); Alois Müller, Barbing (DE)

(73) Assignee: Krones AG, Neutraubling (DE)

( * ) Notice: Subject to any disclaimer, the term of this patent is extended or adjusted under 35 U.S.C. 154(b) by 210 days.

(21) Appl. No.: 10/182,640

(22) PCT Filed: Feb. 3, 2001

(86) PCT No.: PCT/EP01/01174

§ 371 (c)(1),
(2), (4) Date: Oct. 7, 2002

(87) PCT Pub. No.: WO01/58801

PCT Pub. Date: Aug. 16, 2001

(65) Prior Publication Data

US 2003/0089284 A1 May 15, 2003

(30) Foreign Application Priority Data

Feb. 11, 2000 (DE) ..... 200 02 483 U

(51) Int. Cl.[7] ..... A47B 85/00
(52) U.S. Cl. ..... 108/25
(58) Field of Search ..... 422/29, 24, 302; 53/313, 266.1, 286, 316; 108/24, 25, 50.01, 161

(56) References Cited

U.S. PATENT DOCUMENTS 1,812,694 A * 6/1931 Hallowell et al. ..... 108/25
3,179,237 A * 4/1965 Ninneman ..... 53/313
3,745,303 A * 7/1973 Epperson et al. ..... 108/25
4,704,844 A * 11/1987 Mancini ..... 53/453
4,999,972 A * 3/1991 Foster ..... 53/381.1

FOREIGN PATENT DOCUMENTS

DE 3339888 A1 * 5/1985 ..... B65D/81/18

* cited by examiner

*Primary Examiner*—Jose V. Chen
(74) *Attorney, Agent, or Firm*—Marshall, Gerstein & Borun LLP

(57) ABSTRACT

A receiving table for container processing machines having a table top (3) which stands on feet (2) and has transport elements (T) for the containers arranged on it, the table top housing an inclined top plate (3*a*) and a bottom plate (3*b*) which is rigidly connected to the former and together with it forms a cavity (4). The top side of the table top (3) is provided with a water-repellant coating to facilitate runoff of liquids and cleaning of the tablet plate, and yields a stable, lightweight and inexpensive construction.

20 Claims, 2 Drawing Sheets

PRE-TABLE FOR CONTAINER TREATMENT MACHINES

FIELD OF THE INVENTION

This invention relates to a receiving table for a container processing machine, in particular container filling and/or capping machines.

BACKGROUND OF THE INVENTION

It is already known to use such receiving tables, where the table top is made of la single sheet of steel plate having a constant thickness, the plate being arranged at an inclination. Therefore, the bottom side of the table top is necessarily inclined to the horizontal. This leads to problems in mounting the various externally mounted parts such as feet, bearing blocks and supports for the transport elements, linings and so forth, so that these receiving tables have not been successful in practice.

SUMMARY OF THE INVENTION

The object of this invention is to facilitate the mounting of add-on parts significantly in the case of a receiving table of the type defined in the preamble and thereby also lower manufacturing costs.

The table top of a receiving table according to this invention has an inclined top side which facilitates the drainage of fluids and cleaning greatly. On the other hand, since the bottom side of the table top is horizontal, it is just as simple to attach add-on parts as it is with a completely horizontal table top so that now nothing stands in the way of practical use.

Advantageous refinements of this invention yield a stable, lightweight and inexpensive design of the receiving table.

BRIEF DESCRIPTION OF THE DRAWINGS

One embodiment of this invention is described below on the basis of the drawings, which show.

DETAILED DESCRIPTON OF THE INVENTION

Figure 1:
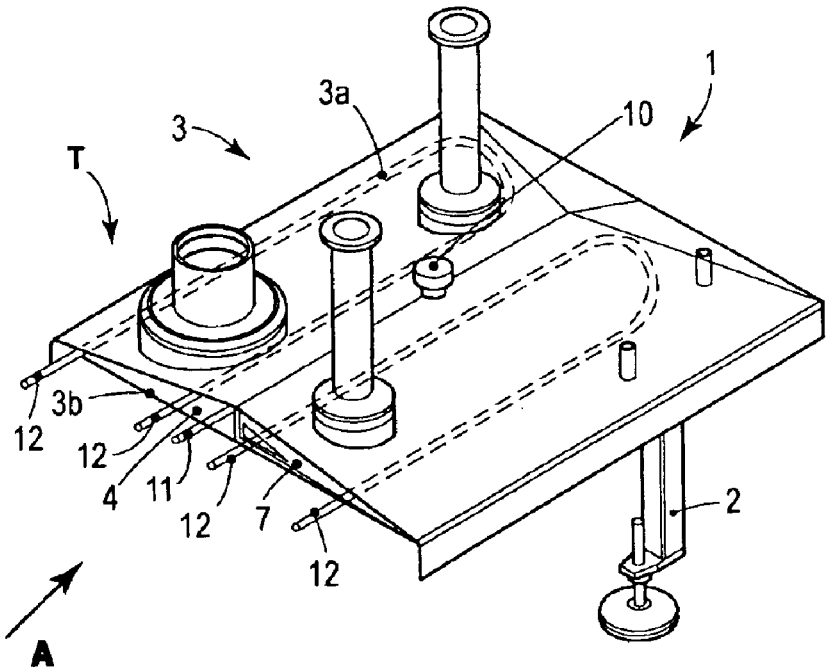
FIG. 1 a perspective view of a receiving table, partially in sectional view, FIG. 2 view A according to FIG. 1, FIG. 3 a perspective view of a bottling machine having the receiving table according to FIGS. 1 and 2.
Figure 2:
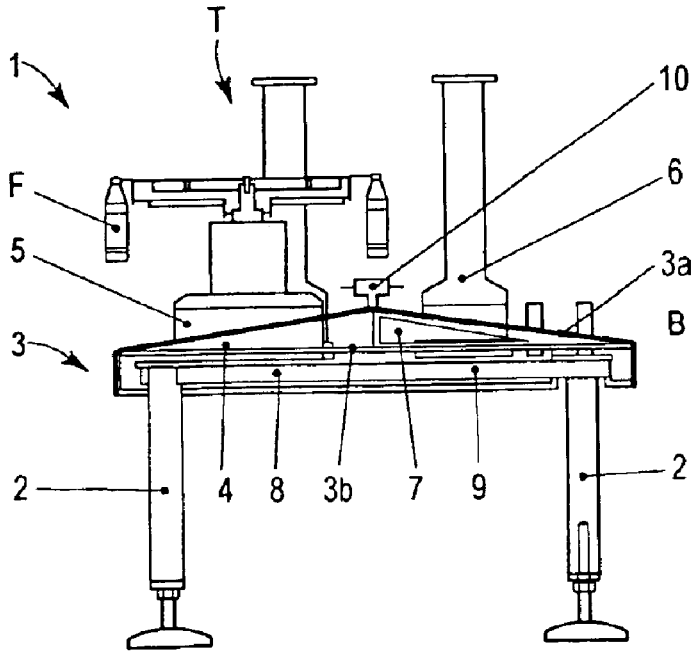

The receiving table 1 according to FIGS. 1 and 2 has a table top 3 having a rectangular basic shape, including a bottom plate 3*b* and a top plate 3*a* positioned above it.

The bottom plate 3*b*, which is otherwise planar, is bent perpendicularly downward at the edge. Several perpendicular feet 2 of the same length are attached to the bottom side and help to set up the table in the horizontal position.

The top plate 3*a* is designed symmetrically in the manner of an Italian roof [a hipped roof, pitched at one or both ends] having a roof slope of 9° and is manufactured by corresponding canting and cutting and welding from an originally planar plate of stainless steel plate in a thickness of 8 mm, just like bottom plate 3*b*. Top plate 3*a* is also bent downward at a right angle at the edge and covers with its bent edge part the bent edge area of bottom plate 3*b*. The two bent edge areas are welded together continuously so they are airtight, and at the same time top plate 3*a* and bottom plate 3*b* are rigidly joined together, enclosing an airtight cavity 4 in the shape of an attic. Several reinforcing ribs 7 are connected to top plate 3*a* and bottom plate 3*b* in this cavity. In addition, cavity 4 may also be filled with foam.

Because of the specified design, table top 3 has high stability by using a relatively small amount of material and it forms a type of self-supporting hollow profile. The top side of table top 3 is inclined toward four sides and facilitates runoff of filling liquid or cleaning liquid and also prevents dirt from collecting. It is of course also possible to provide the top side of table top 3 with two inclined surfaces in the manner of a saddleback roof or with just one inclined surface in the manner of a shed roof. In this case, perpendicular walls are additionally required to form an enclosed hollow space together with top plate 3*a* and bottom plate 3*b*. It is also possible to apply a water-repellant coating on the top side of table top 3.

Figure 3:
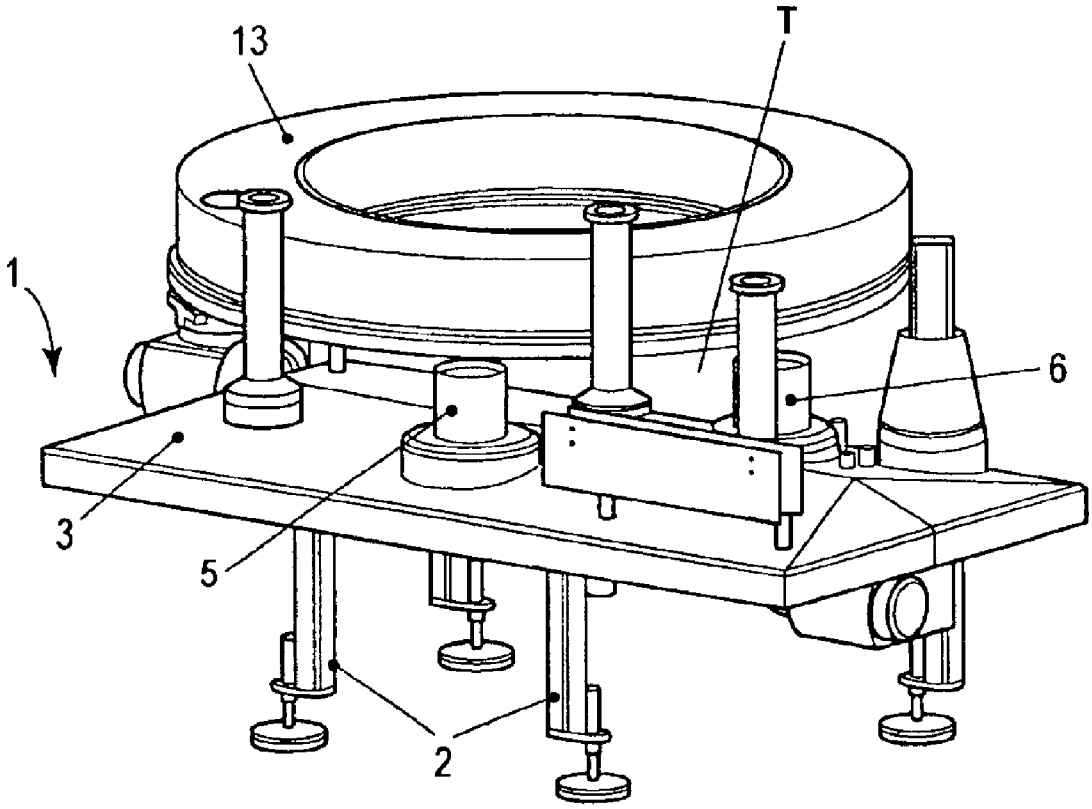

The bottom side of table top 3 runs horizontally, greatly facilitating installation by means of feet 2 of the same length with horizontal end faces. The same thing is also true of attachment of bearing columns 5, 6 for transport stars, rotating tables or the like, as illustrated by FIG. 3 in particular. Such add-on parts are connected through concentric boreholes in top plate 3*a* and bottom plate 3*b* so that they are screwed or welded to bottom plate 3*b* and finally are sealed by a weld or the like with respect to top plate 3*a*. Therefore, no adaptation of these add-on parts to the inclined top surface of table top 3*a* is necessary.

Several rotating spray nozzles 10 are mounted on the top side of top plate 3*a* at the highest point (peak of the roof). These spray nozzles are connected to a supply line 11 installed in the cavity 4, connected by a cutoff valve (not shown) to a supply unit (not shown) for pressurized liquid cleaning medium. By manual or automatic opening of the cutoff valve, it is possible to spray down the top side of table top 3 and thus remove dirt, chards, etc. This effectively prevents soiling or microbial growth.

In addition, a heating device 12 is provided in hollow space 4 having an electric oil-filled heating spiral with thermostatic control, for example. This is installed close to top plate 3*a* so that it may be heated with a relatively low consumption of energy. Thus, droplets of liquid remaining after spraying down the surface can evaporate rapidly, thus effectively preventing microbial growth.

The bottle filling and capping machine illustrated in FIG. 3 has a rotating ring vessel 13 having filling valves (not shown) and provided with a receiving table according to this invention as illustrated in FIGS. 1 and 2. The empty bottles F are supplied to ring vessel 13 by transport and conveyor elements T on the receiving table, e.g., conveyor stars, conveyor belts, adjusting screws, rotating tables and the like, then after being filled, the bottles are removed from it and next they are conveyed through the bottle capping device which is also mounted on receiving table 1 and finally they are conveyed away from the bottle filling and capping machine. It is good to recognize that both the bottom side and the top side of receiving table 1 together with the add-on parts are readily accessible and easy to clean so that completely or virtually germ-free operation is possible with suitable accessory equipment.

The abovementioned water-repellant and dirt-repellant coating is indicated at the right edge of table top 3 in FIG. 2 where is it labeled as B. It covers the entire outer surface of top plate 3*a* and may extend also to the bearing columns 5, 6 and other add-on parts. Coating B is made of PTFE, a plastic having good water-repellency properties, easy to clean and also applied with good adhesion to the tablet plate 3 made of stainless steel.

The exterior surface of coating B is either extremely smooth or is provided with elevations and indentations in the nanometer or micrometer range, preventing adhesion of particles of dirt in the manner of a "lotus effect" and ensure a self-cleaning effect; i.e., all impurities are removed by simply rinsing with water.

The coating B described above works together synergistically with the inclined table top surface in the sense of simple cleaning and automatic runoff of liquids, product residues, etc. However, coating B may also be applied to horizontal table tops and it makes a contribution to simple effortless cleaning even here and counteracts microbial growth and soiling.

What is claimed is:

1. A receiving table (1) for container processing machines, comprising a table top (3) which stands on feet (2), transport elements (T) for the containers being arranged on the table top, the top side of the table top being inclined with respect to the horizontal, and a bottom side of the table top running horizontally, wherein the table top (3) has at least one inclined top plate (3*a*) and at least one horizontal bottom plate (3*b*) that are rigidly joined together, and wherein the top plate (3*a*) and the bottom plate (3*b*) enclose a cavity (4) that is filled with foam.

2. The receiving table according to claim 1, wherein the cavity (4) is sealed airtight.

3. The receiving table according to claim 1, wherein the top plate (3*a*) and the bottom plate (3*b*) are bent downward at the edge in the manner of a flange and are joined together in the bent edge area.

4. The receiving table according to claim 3, and gear wheels (8, 9) for the transport element (T) are arranged within the space bordered by the bent edge area.

5. The receiving table according to claim 1, wherein the top plate (3*a*) and the bottom plate (3*b*) have essentially the same rectangular design.

6. The receiving table according to claim 1, wherein at least one end of the top plate (3*a*) is pitched, while the bottom plate (3*b*) is essentially planar.

7. The receiving table according to claim 1, wherein several feet (2) of the same length are attached to one of the bottom side of the table top (3) or the bottom plate (3*b*).

8. The receiving table according to claim 1, and at least one reinforcing rib (7) is arranged in the cavity (4) and is connected to the top plate (3*a*) and the bottom plate (3*b*).

9. The receiving table according to claim 1, and at least one perpendicular bearing block (5, 6) for a transport element (T) which passes through the cavity (4) and is attached at least to the bottom plate (3*b*) and is sealed with respect to the top plate (3*a*).

10. The receiving table according to claim 1, and at least one spray nozzle (10) is arranged on the top plate (3*a*) and is connected to a supply line (11) installed in the cavity (4).

11. The receiving table according to claim 10, wherein the spray nozzle (19) is rotatable.

12. The receiving table according to claim 10, wherein the at least one spray nozzle (10) is arranged at a highest point on the top plate.

13. The receiving table according to claim 1, and a heating device (12) for the table top (3) situated in the cavity (4).

14. The receiving table according to claim 1, wherein the top side of the table top (3) is provided with a water-repellant coating (B).

15. The receiving table according to claim 14, wherein the coating (B) has antibacterial properties.

16. The receiving table according to claim 14 or 15, wherein the coating (B) has self-cleaning properties.

17. The receiving table according to claim 14 or 15, wherein the coating (B) is made of plastic.

18. A receiving table (1) for container processing machines, comprising a table top (3) which stands on feet (2), transport elements (T) for the containers being arranged on the table top, the top side of the table top being inclined with respect to the horizontal, and a bottom side of the table top running horizontally, wherein the table top (3) has at least one inclined top plate (3*a*) and at least one horizontal bottom plate (3*b*) that are rigidly joined together, and wherein the top plate (3*a*) and the bottom plate (3*b*) enclose a cavity (4) that is sealed airtight.

19. A receiving table (1) for container processing machines, comprising a table top (3) which stands on feet (2), transport elements (T) for the containers being arranged on the table top, the top side of the table top being inclined with respect to the horizontal, and a bottom side of the table top running horizontally, wherein the top plate (3*a*) and the bottom plate (3*b*) are bent downward at the edge in the manner of a flange and are joined together in the bent edge area.

20. The receiving table according to claim 19, and gear wheels (8, 9) for the transport element (T) are arranged within the space bordered by the bent edge area.

* * * * *

UNITED STATES PATENT AND TRADEMARK OFFICE

CERTIFICATE OF CORRECTION

PATENT NO. : 6,935,246 B2
APPLICATION NO. : 10/182640
DATED : August 30, 2005
INVENTOR(S) : Erich Eder et al.

It is certified that error appears in the above-identified patent and that said Letters Patent is hereby corrected as shown below:

On The Title Page:

Item -30-, "20002483" should be -- 20002483.3 --.

Item -57-, line 4, "housing" should be -- having --.

Signed and Sealed this

Twenty-seventh Day of May, 2008

JON W. DUDAS
*Director of the United States Patent and Trademark Office*